US012540449B2

(12) United States Patent
Sano et al.

(10) Patent No.: US 12,540,449 B2
(45) Date of Patent: Feb. 3, 2026

(54) SHOVEL AND METHOD OF CONTROLLING SHOVEL

(71) Applicant: SUMITOMO CONSTRUCTION MACHINERY CO., LTD., Tokyo (JP)

(72) Inventors: Kiminori Sano, Chiba (JP); Ryuji Shiratani, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 438 days.

(21) Appl. No.: 17/447,301

(22) Filed: Sep. 10, 2021

(65) Prior Publication Data

US 2021/0404141 A1 Dec. 30, 2021

Related U.S. Application Data

(63) Continuation of application No. PCT/JP2020/010466, filed on Mar. 11, 2020.

(30) Foreign Application Priority Data

Mar. 11, 2019 (JP) ..... 2019-043686

(51) Int. Cl.
*E02F 3/42* (2006.01)
*E02F 3/43* (2006.01)
*E02F 9/22* (2006.01)

(52) U.S. Cl.
CPC ..... *E02F 3/425* (2013.01); *E02F 3/435* (2013.01); *E02F 9/2235* (2013.01); *E02F 9/2296* (2013.01)

(58) Field of Classification Search
CPC ..... E02F 3/425; E02F 3/435; E02F 9/2235; E02F 9/2296
See application file for complete search history.

(56) References Cited

U.S. PATENT DOCUMENTS

| | | | | |
|---|---|---|---|---|
| 6,389,808 | B1 * | 5/2002 | Sakai | E02F 9/2246 60/329 |
| 8,744,654 | B2 | 6/2014 | Wu | |
| 2006/0150621 | A1 * | 7/2006 | Nakata | F15B 21/0427 374/E3.007 |
| 2011/0146283 | A1 * | 6/2011 | Narazaki | E02F 9/2282 60/701 |

(Continued)

FOREIGN PATENT DOCUMENTS

| | | |
|---|---|---|
| EP | 2489883 | 8/2012 |
| JP | H06-117412 | 4/1994 |

(Continued)

OTHER PUBLICATIONS

International Search Report for PCT/JP2020/010466 mailed on Jun. 9, 2020.

*Primary Examiner* — Anne Marie Antonucci
*Assistant Examiner* — Patrick M Brady
(74) *Attorney, Agent, or Firm* — IPUSA, PLLC

(57) ABSTRACT

A shovel includes a lower traveling structure, an upper swing structure swingably mounted on the lower traveling structure, an engine mounted on the upper swing structure, a hydraulic pump configured to be driven by the engine, and processing circuitry configured to determine a command value by energy saving control and to control a flow rate of hydraulic oil discharged by the hydraulic pump according to the command value. The processing circuitry is configured to control the command value.

10 Claims, 6 Drawing Sheets

(56) References Cited

U.S. PATENT DOCUMENTS

| | | | | |
|---|---|---|---|---|
| 2012/0247094 | A1* | 10/2012 | Koga | E02F 9/2235 60/420 |
| 2013/0318971 | A1* | 12/2013 | Sora | F04B 49/08 60/431 |
| 2014/0350800 | A1* | 11/2014 | Yoshida | F02D 29/02 701/50 |
| 2016/0265195 | A1* | 9/2016 | Imura | E02F 9/2075 |
| 2016/0265561 | A1* | 9/2016 | Takahashi | E02F 9/2292 |
| 2016/0356021 | A1* | 12/2016 | Sugaya | E02F 9/2285 |
| 2018/0274208 | A1* | 9/2018 | Hijikata | F15B 13/06 |
| 2021/0340731 | A1* | 11/2021 | Takahashi | E02F 9/2292 |

FOREIGN PATENT DOCUMENTS

| | | |
|---|---|---|
| JP | H09-317703 | 12/1997 |
| JP | H11-311203 | 11/1999 |
| JP | 2005-060970 | 3/2005 |
| JP | 2008-002505 | 1/2008 |
| JP | 2008-150877 | 7/2008 |
| JP | 4843105 | 12/2011 |
| JP | 2014-222104 | 11/2014 |
| JP | 2015-218537 | 12/2015 |
| JP | 2017-057694 | 3/2017 |
| JP | 2017-57926 | 3/2017 |
| WO | 2009/123047 | 10/2009 |

* cited by examiner

SHOVEL AND METHOD OF CONTROLLING SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/010466, filed on Mar. 11, 2020 and designating the U.S., which claims priority to Japanese Patent Application No. 2019-043686, filed on Mar. 11, 2019. The entire contents of the foregoing applications are incorporated herein by reference.

BACKGROUND

Technical Field

The present disclosure relates to shovels as excavators and methods of controlling a shovel.

Description of Related Art

Shovels including a controller that controls the discharge quantity of a hydraulic pump based on a negative control pressure have been known.

SUMMARY

According to an aspect of the present invention, a shovel includes a lower traveling structure, an upper swing structure swingably mounted on the lower traveling structure, an engine mounted on the upper swing structure, a hydraulic pump configured to be driven by the engine, and processing circuitry configured to determine a command value by energy saving control and to control a flow rate of hydraulic oil discharged by the hydraulic pump according to the command value. The processing circuitry is configured to control the command value.

DETAILED DESCRIPTION

The above-described related-art controller, however, rapidly increases the discharge quantity, for example, when the negative control pressure suddenly decreases in starting a hydraulic actuator. As a result, the above-described controller may rapidly move the hydraulic actuator to cause a shock.

Therefore, it is desirable to control a shock that is caused when moving a hydraulic actuator.

According to an embodiment of the present invention, a shovel that can control a shock that is caused when moving a hydraulic actuator is provided.

Figure 1:
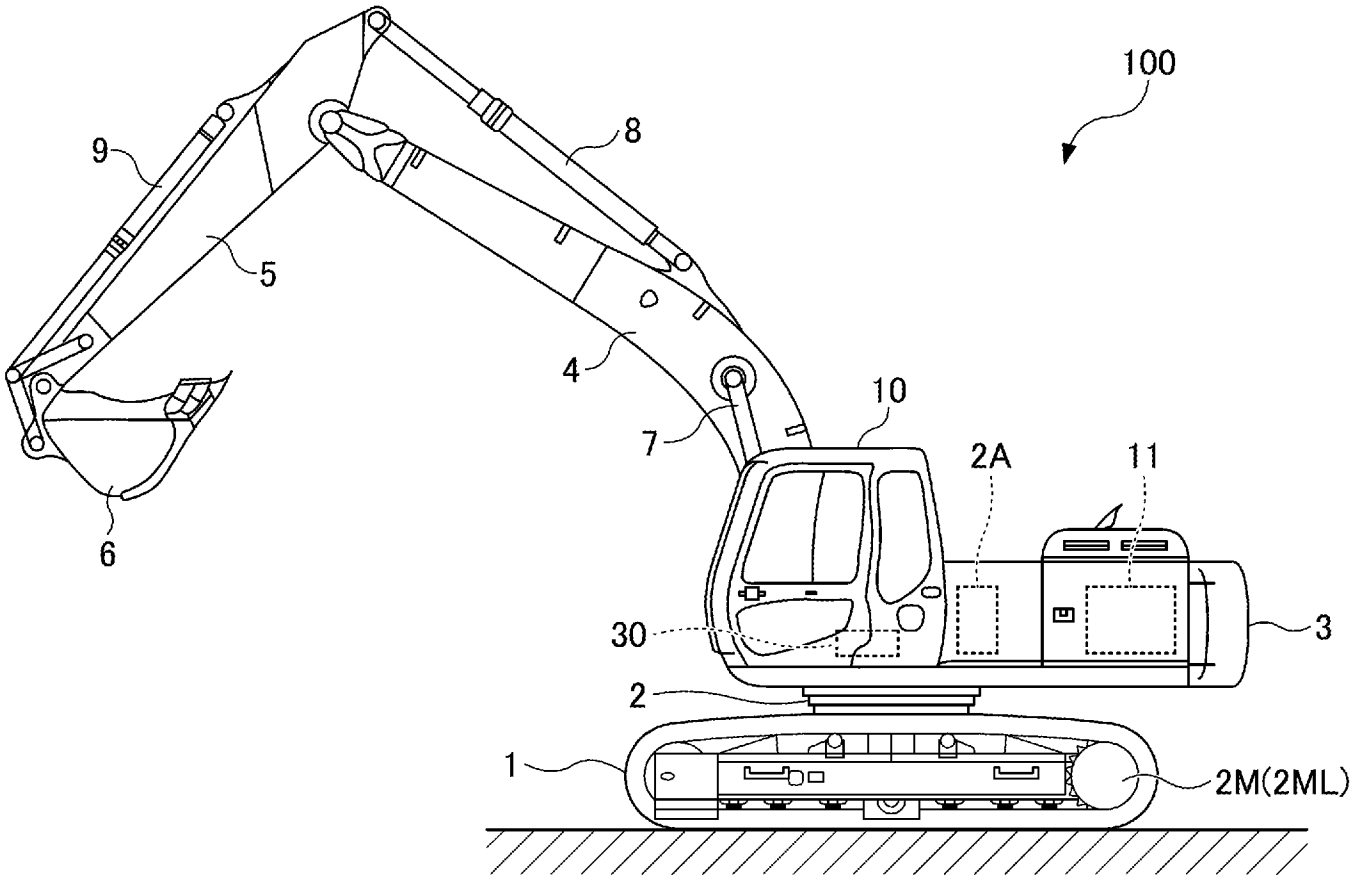
FIG. 1 is a side view of a shovel according to an embodiment of the present invention.

First, a shovel 100 serving as an excavator according to an embodiment of the present invention is described with reference to FIG. 1. FIG. 1 is a side view of the shovel 100. According to this embodiment, an upper swing structure 3 is swingably mounted on a lower traveling structure 1 via a swing mechanism 2. The lower traveling structure 1 is driven by travel hydraulic motors 2M. The travel hydraulic motors 2M include a left travel hydraulic motor 2ML that drives a left crawler and a right travel hydraulic motor 2MR that drives a right crawler (not visible in FIG. 1). The swing mechanism 2 is driven by a swing hydraulic motor 2A mounted on the upper swing structure 3. The swing hydraulic motor 2A, however, may alternatively be a swing motor generator serving as an electric actuator.

A boom 4 is attached to the upper swing structure 3. An arm 5 is attached to the distal end of the boom 4. A bucket 6 serving as an end attachment is attached to the distal end of the arm 5. The boom 4, the arm 5, and the bucket 6 constitute an excavation attachment that is an example of an attachment. The boom 4 is driven by a boom cylinder 7. The arm 5 is driven by an arm cylinder 8. The bucket 6 is driven by a bucket cylinder 9.

A cabin 10 serving as a cab is provided and a power source such as an engine 11 is mounted on the upper swing structure 3. Furthermore, a controller 30 is attached to the upper swing structure 3. In this specification, for convenience, the side of the upper swing structure 3 on which the boom 4 is attached is defined as the front side, and the side of the upper swing structure 3 on which a counterweight is attached is defined as the back side.

The controller 30 is a control device (processing circuitry) configured to control the shovel 100. According to this embodiment, the controller 30 is constituted of a computer including a CPU, a volatile storage, and a nonvolatile storage. The controller 30 is so configured as to be able to implement various functions by reading programs corresponding to various functional elements from the nonvolatile storage and causing the CPU to execute corresponding processes.

Figure 2:
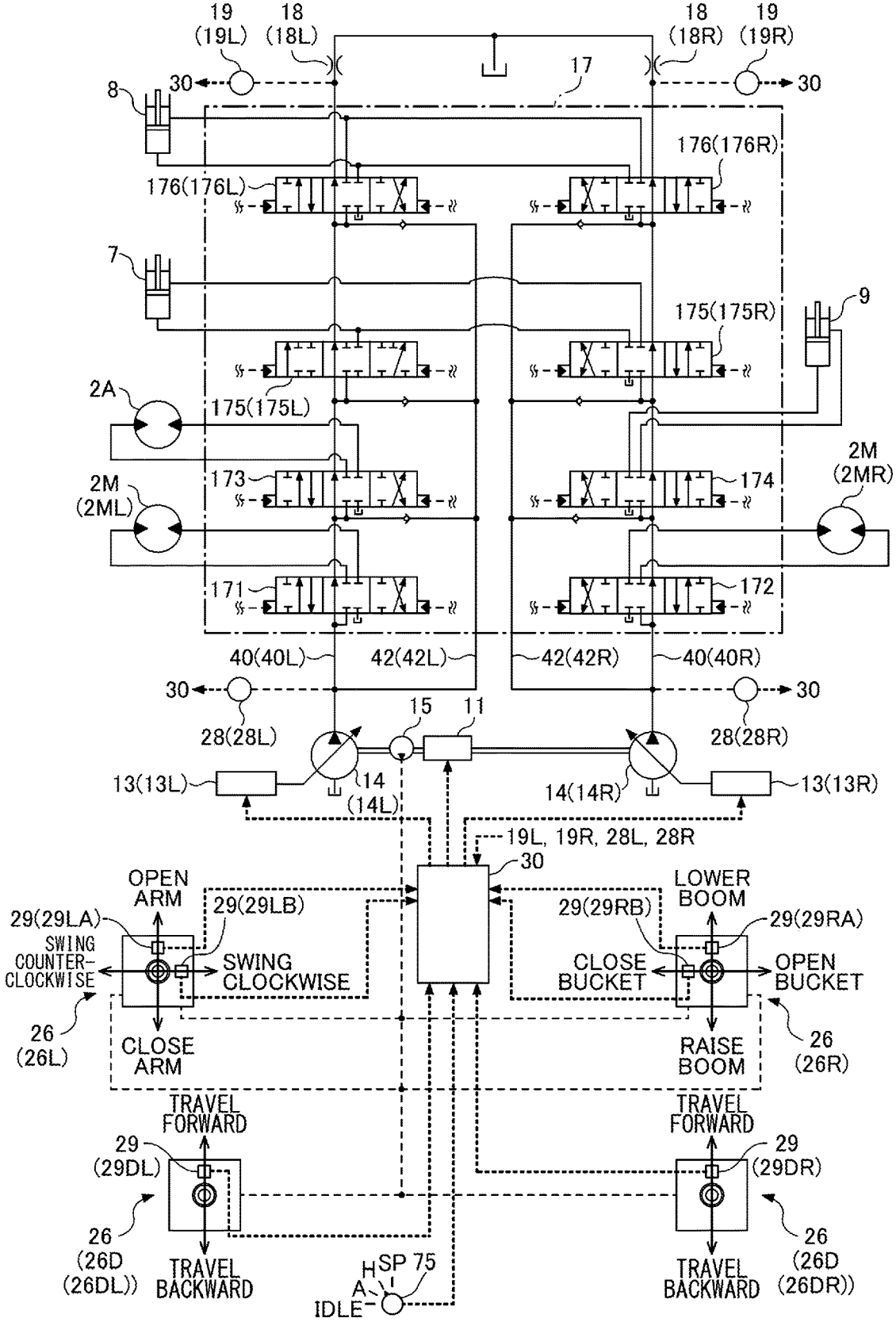
FIG. 2 is a diagram illustrating an example configuration of a hydraulic system installed in the shovel.

Next, an example configuration of a hydraulic system installed in the shovel 100 is described with reference to FIG. 2. FIG. 2 is a diagram illustrating an example configuration of the hydraulic system installed in the shovel 100. In FIG. 2, a mechanical power transmission system, a hydraulic oil line, a pilot line, and an electrical control system are indicated by a double line, a solid line, a dashed line, and a dotted line, respectively.

The hydraulic system of the shovel 100 mainly includes the engine 11, a regulator 13, a main pump 14, a pilot pump 15, a control valve unit 17, an operating device 26, a discharge pressure sensor 28, an operating pressure sensor 29, the controller 30, and an engine rotational speed adjustment dial 75.

In FIG. 2, the hydraulic system circulates hydraulic oil from the main pump 14 driven by the engine 11 to a hydraulic oil tank via at least one of a center bypass conduit 40 and a parallel conduit 42.

The engine 11 is a power source for the shovel 100. According to this embodiment, the engine 11 is, for example, a diesel engine that operates in such a manner as to maintain a predetermined rotational speed. The output shaft of the engine 11 is connected to the input shaft of each of the main pump 14 and the pilot pump 15.

The main pump 14 is configured to supply hydraulic oil to the control valve unit 17 via a hydraulic oil line. According to this embodiment, the main pump 14 is an electrically controlled hydraulic pump. Specifically, the main pump 14 is a swash plate variable displacement hydraulic pump.

The regulator 13 controls the discharge quantity of the main pump 14. According to this embodiment, the regulator 13 controls the discharge quantity of the main pump 14 by controlling the geometric displacement per revolution of the main pump 14 by adjusting the swash plate tilt angle of the main pump 14 in response to a control command from the controller 30.

The pilot pump 15 is configured to supply hydraulic oil to hydraulic control devices including the operating device 26 via a pilot line. According to this embodiment, the pilot pump 15 is a fixed displacement hydraulic pump. The pilot pump 15 may be omitted. In this case, the function carried by the pilot pump 15 may be implemented by the main pump 14. That is, the main pump 14 may have the function of supplying hydraulic oil to the operating device 26, etc., after reducing the pressure of the hydraulic oil with a throttle or the like, apart from the function of supplying hydraulic oil to the control valve unit 17.

The control valve unit 17 is a hydraulic controller that controls the hydraulic system in the shovel 100. According to this embodiment, the control valve unit 17 includes control valves 171 through 176 as indicated by a one-dot chain line. The control valve 175 includes a control valve 175L and a control valve 175R. The control valve 176 includes a control valve 176L and a control valve 176R. The control valve unit 17 can selectively supply hydraulic oil discharged by the main pump 14 to one or more hydraulic actuators through one or more control valves among the control valves 171 through 176. The control valves 171 through 176 control the flow rate of hydraulic oil flowing from the main pump 14 to the hydraulic actuators and the flow rate of hydraulic oil flowing from the hydraulic actuators to the hydraulic oil tank. The hydraulic actuators include the boom cylinder 7, the arm cylinder 8, the bucket cylinder 9, the left travel hydraulic motor 2ML, the right travel hydraulic motor 2MR, and the swing hydraulic motor 2A.

The operating device 26 is a device that the operator uses to operate actuators. The actuators include at least one of a hydraulic actuator and an electric actuator. According to this embodiment, the operating device 26 is configured to supply hydraulic oil discharged by the pilot pump 15 to a pilot port of a corresponding control valve in the control valve unit 17 via a pilot line. A pilot pressure, which is the pressure of hydraulic oil supplied to each pilot port, is a pressure commensurate with the direction of operation and the amount of operation of a lever or a pedal (not depicted) of the operating device 26 corresponding to each hydraulic actuator.

The discharge pressure sensor 28 is configured to detect the discharge pressure of the main pump 14. According to this embodiment, the discharge pressure sensor 28 outputs a detected value to the controller 30.

The operating pressure sensor 29 is configured to detect the details of an operation through the operating device 26. According to this embodiment, the operating pressure sensor 29 detects the direction of operation and the amount of operation of a lever or a pedal serving as the operating device 26 corresponding to each actuator in the form of pressure (operating pressure), and outputs the detected value to the controller 30. The operation details of the operating device 26 may also be detected using a sensor other than an operating pressure sensor.

The main pump 14 includes a left main pump 14L and a right main pump 14R. The left main pump 14L circulates hydraulic oil to the hydraulic oil tank via a left center bypass conduit 40L or a left parallel conduit 42L. The right main pump 14R circulates hydraulic oil to the hydraulic oil tank via a right center bypass conduit 40R or a right parallel conduit 42R.

The left center bypass conduit 40L is a hydraulic oil line that passes through the control valves 171, 173, 175L, and 176L placed in the control valve unit 17. The right center bypass conduit 40R is a hydraulic oil line that passes through the control valves 172, 174, 175R, and 176R placed in the control valve unit 17.

The control valve 171 is a spool valve that switches the flow of hydraulic oil to supply hydraulic oil discharged by the left main pump 14L to the left travel hydraulic motor 2ML and to discharge hydraulic oil discharged by the left travel hydraulic motor 2ML to the hydraulic oil tank.

The control valve 172 is a spool valve that switches the flow of hydraulic oil to supply hydraulic oil discharged by the right main pump 14R to the right travel hydraulic motor 2MR and to discharge hydraulic oil discharged by the right travel hydraulic motor 2MR to the hydraulic oil tank.

The control valve 173 is a spool valve that switches the flow of hydraulic oil to supply hydraulic oil discharged by the left main pump 14L to the swing hydraulic motor 2A and to discharge hydraulic oil discharged by the swing hydraulic motor 2A to the hydraulic oil tank.

The control valve 174 is a spool valve that switches the flow of hydraulic oil to supply hydraulic oil discharged by the right main pump 14R to the bucket cylinder 9 and to discharge hydraulic oil in the bucket cylinder 9 to the hydraulic oil tank.

The control valve 175L is a spool valve that switches the flow of hydraulic oil to supply hydraulic oil discharged by the left main pump 14L to the boom cylinder 7. The control valve 175R is a spool valve that switches the flow of hydraulic oil to supply hydraulic oil discharged by the right main pump 14R to the boom cylinder 7 and to discharge hydraulic oil in the boom cylinder 7 to the hydraulic oil tank.

The control valve 176L is a spool valve that switches the flow of hydraulic oil to supply hydraulic oil discharged by the left main pump 14L to the arm cylinder 8 and to discharge hydraulic oil in the arm cylinder 8 to the hydraulic oil tank. The control valve 176R is a spool valve that switches the flow of hydraulic oil to supply hydraulic oil discharged by the right main pump 14R to the arm cylinder 8 and to discharge hydraulic oil in the arm cylinder 8 to the hydraulic oil tank.

The left parallel conduit 42L is a hydraulic oil line running parallel to the left center bypass conduit 40L. When the flow of hydraulic oil through the left center bypass conduit 40L is restricted or blocked by any of the control valves 171, 173 and 175L, the left parallel conduit 42L can supply hydraulic oil to a control valve further downstream. The right parallel conduit 42R is a hydraulic oil line running parallel to the right center bypass conduit 40R. When the flow of hydraulic oil through the right center bypass conduit 40R is restricted or blocked by any of the control valves 172, 174 and 175R, the right parallel conduit 42R can supply hydraulic oil to a control valve further downstream.

The regulator 13 includes a left regulator 13L and a right regulator 13R. The left regulator 13L is configured to control the discharge quantity of the left main pump 14L by adjusting the swash plate tilt angle of the left main pump 14L in accordance with the discharge pressure of the left main pump 14L. This control is referred to as power control or horsepower control. Specifically, the left regulator 13L, for example, reduces the discharge quantity of the left main pump 14L by reducing its geometric displacement per revolution by adjusting its swash plate tilt angle, according as the discharge pressure of the left main pump 14L increases. The same is the case with the right regulator 13R. This is for preventing the absorbed power (absorbed horsepower) of the main pump 14, expressed as the product of discharge pressure and discharge quantity, from exceeding the output power (output horsepower) of the engine 11.

The operating device 26 includes a left operating lever 26L, a right operating lever 26R, and travel levers 26D. The travel levers 26D include a left travel lever 26DL and a right travel lever 26DR.

The left operating lever 26L is used for swing operation and for operating the arm 5. The left operating lever 26L is operated forward or backward to cause a pilot pressure commensurate with the amount of lever operation to act on a pilot port of the control valve 176, using hydraulic oil discharged by the pilot pump 15. The left operating lever 26L is operated rightward or leftward to cause a pilot pressure commensurate with the amount of lever operation to act on a pilot port of the control valve 173, using hydraulic oil discharged by the pilot pump 15.

Specifically, the left operating lever 26L is operated in an arm closing direction to cause hydraulic oil to flow into the right pilot port of the control valve 176L and cause hydraulic oil to flow into the left pilot port of the control valve 176R. Furthermore, the left operating lever 26L is operated in an arm opening direction to cause hydraulic oil to flow into the left pilot port of the control valve 176L and cause hydraulic oil to flow into the right pilot port of the control valve 176R. Furthermore, the left operating lever 26L is operated in a counterclockwise swing direction to cause hydraulic oil to flow into the left pilot port of the control valve 173, and is operated in a clockwise swing direction to cause hydraulic oil to flow into the right pilot port of the control valve 173.

The right operating lever 26R is used to operate the boom 4 and operate the bucket 6. The right operating lever 26R is operated forward or backward to cause a pilot pressure commensurate with the amount of lever operation to act on a pilot port of the control valve 175, using hydraulic oil discharged by the pilot pump 15. The right operating lever 26R is operated rightward or leftward to cause a pilot pressure commensurate with the amount of lever operation to act on a pilot port of the control valve 174, using hydraulic oil discharged by the pilot pump 15.

Specifically, the right operating lever 26R is operated in a boom lowering direction to cause hydraulic oil to flow into the right pilot port of the control valve 175R. Furthermore, the right operating lever 26R is operated in a boom raising direction to cause hydraulic oil to flow into the right pilot port of the control valve 175L and cause hydraulic oil to flow into the left pilot port of the control valve 175R. The right operating lever 26R is operated in a bucket closing direction to cause hydraulic oil to flow into the left pilot port of the control valve 174, and is operated in a bucket opening direction to cause hydraulic oil to flow into the right pilot port of the control valve 174.

The travel levers 26D are used to operate the crawlers. Specifically, the left travel lever 26DL is used to operate the left crawler. The left travel lever 26DL may be configured to operate together with a left travel pedal. The left travel lever 26DL is operated forward or backward to cause a pilot pressure commensurate with the amount of lever operation to act on a pilot port of the control valve 171, using hydraulic oil discharged by the pilot pump 15. The right travel lever 26DR is used to operate the right crawler. The right travel lever 26DR may be configured to operate together with a right travel pedal. The right travel lever 26DR is operated forward or backward to cause a pilot pressure commensurate with the amount of lever operation to act on a pilot port of the control valve 172, using hydraulic oil discharged by the pilot pump 15.

The discharge pressure sensor 28 includes a discharge pressure sensor 28L and a discharge pressure sensor 28R. The discharge pressure sensor 28L detects the discharge pressure of the left main pump 14L, and outputs the detected value to the controller 30. The same is the case with the discharge pressure sensor 28R.

The operating pressure sensor 29 includes operating pressure sensors 29LA, 29LB, 29RA, 29RB, 29DL and 29DR. The operating pressure sensor 29LA detects the details of a forward or backward operation on the left operating lever 26L in the form of pressure, and outputs the detected value to the controller 30. Examples of the details of operation include the direction of lever operation and the amount of lever operation (the angle of lever operation).

Likewise, the operating pressure sensor 29LB detects the details of a rightward or leftward operation on the left operating lever 26L in the form of pressure, and outputs the detected value to the controller 30. The operating pressure sensor 29RA detects the details of a forward or backward operation on the right operating lever 26R in the form of pressure, and outputs the detected value to the controller 30. The operating pressure sensor 29RB detects the details of a rightward or leftward operation on the right operating lever 26R in the form of pressure, and outputs the detected value to the controller 30. The operating pressure sensor 29DL detects the details of a forward or backward operation on the left travel lever 26DL in the form of pressure, and outputs the detected value to the controller 30. The operating pressure sensor 29DR detects the details of a forward or backward operation on the right travel lever 26DR in the form of pressure, and outputs the detected value to the controller 30.

The controller 30 may receive the output of the operating pressure sensor 29, and output a control command to the regulator 13 to change the discharge quantity of the main pump 14 on an as-needed basis.

Furthermore, the controller 30 is configured to perform negative control as energy saving control using a throttle 18 and a control pressure sensor 19. The throttle 18 includes a left throttle 18L and a right throttle 18R and the control pressure sensor 19 includes a left control pressure sensor 19L and a right control pressure sensor 19R. According to this embodiment, the control pressure sensor 19 operates as a negative control pressure sensor. The energy saving control is control to reduce the discharge quantity of the main pump 14 in order to prevent the main pump 14 from wasting energy.

The left throttle 18L is placed between the most downstream control valve 176L and the hydraulic oil tank in the left center bypass conduit 40L. Therefore, the flow of hydraulic oil discharged by the left main pump 14L is restricted by the left throttle 18L. The left throttle 18L generates a control pressure (a negative control pressure) for controlling the left regulator 13L. The left control pressure sensor 19L is a sensor for detecting this control pressure, and outputs a detected value to the controller 30. The controller 30 controls the discharge quantity of the left main pump 14L according to the negative control by adjusting the swash plate tilt angle of the left main pump 14L in accordance with this control pressure. Typically, the controller 30 decreases the discharge quantity of the left main pump 14L as this control pressure increases, and increases the discharge quantity of the left main pump 14L as this control pressure decreases. The discharge quantity of the right main pump 14R is controlled in the same manner.

Specifically, when the shovel 100 is in a standby state as illustrated in FIG. 2, hydraulic oil discharged by the left main pump 14L arrives at the left throttle 18L through the left center bypass conduit 40L. The standby state is a state where, for example, none of the hydraulic actuators in the shovel 100 is operated although the hydraulic actuators are operable (no hydraulic actuators are operated although a gate lock is released). The flow of hydraulic oil discharged by the left main pump 14L increases the control pressure generated upstream of the left throttle 18L. As a result, the controller 30 decreases the discharge quantity of the left main pump 14L to a standby flow rate to reduce pressure loss (pumping loss) during the passage of the discharged hydraulic oil through the left center bypass conduit 40L. The standby flow rate is a predetermined flow rate that is employed in the standby state, and is, for example, a minimum allowable discharge quantity. In contrast, when any of the hydraulic actuators is operated, hydraulic oil discharged by the left main pump 14L flows into the operated hydraulic actuator via a control valve corresponding to the operated hydraulic actuator. The control valve corresponding to the operated hydraulic actuator causes the flow rate of hydraulic oil arriving at the left throttle 18L to decrease or become zero to reduce the control pressure generated upstream of the left throttle 18L. As a result, the controller 30 increases the discharge quantity of the left main pump 14L to circulate sufficient hydraulic oil to the operated hydraulic actuator to ensure driving of the operated hydraulic actuator. The controller 30 controls the discharge quantity of the right main pump 14R in the same manner.

According to the negative control as described above, the hydraulic system of FIG. 2 can control unnecessary energy consumption in the main pump 14 in the standby state. The unnecessary energy consumption includes pumping loss that hydraulic oil discharged by the main pump 14 causes in the center bypass conduit 40. Furthermore, in the case of actuating a hydraulic actuator, the hydraulic system of FIG. 2 can ensure that necessary and sufficient hydraulic oil is supplied from the main pump 14 to the hydraulic actuator to be actuated.

The engine rotational speed adjustment dial 75 is a dial for adjusting the rotational speed of the engine 11. The engine rotational speed adjustment dial 75 transmits data indicating the setting of the engine rotational speed to the controller 30. According to this embodiment, the engine rotational speed adjustment dial 75 is configured to allow the engine rotational speed to be selected from the four levels of SP mode, H mode, A mode, and IDLE mode. The SP mode is a rotational speed mode selected when it is desired to prioritize workload, and uses the highest engine rotational speed. The H mode is a rotational speed mode selected when it is desired to satisfy both workload and fuel efficiency, and uses the second highest engine rotational speed. The A mode is a rotational speed mode selected when it is desired to operate the shovel 100 with low noise while prioritizing fuel efficiency, and uses the third highest engine rotational speed. The IDLE mode is a rotational speed mode selected when it is desired to idle the engine 11, and uses the lowest engine rotational speed. The engine 11 is controlled to constantly rotate at the engine rotational speed of a rotational speed mode set by the engine rotational speed adjustment dial 75.

Figure 3:
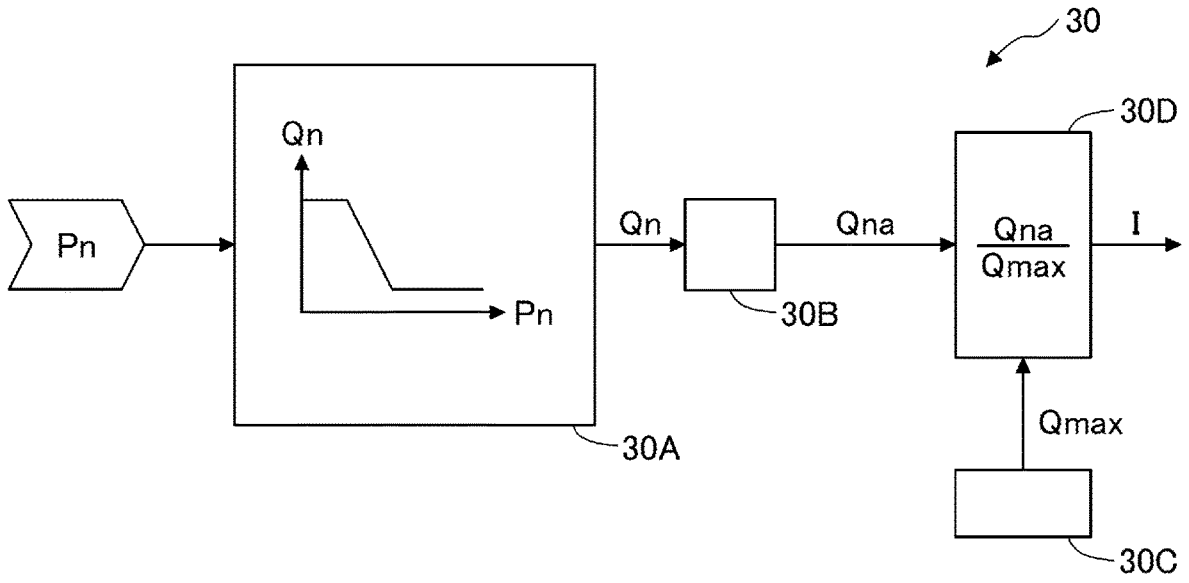
FIG. 3 is a diagram illustrating an example configuration of a discharge quantity control function.

Next, an example of the function of the controller 30 to control the discharge quantity of the main pump 14 (hereinafter "discharge quantity control function") is described with reference to FIG. 3. FIG. 3 is an example configuration of the controller 30 that implements the discharge quantity control function. According to the example of FIG. 3, the controller 30 includes an energy saving control part 30A, a control part 30B, a maximum value setting part 30C, and a current command output part 30D. The energy saving control part 30A, the control part 30B, the maximum value setting part 30C, and the current command output part 30D are expressions used for convenience in describing functions of the controller 30, and do not have to be physically independent. The functions implemented by the energy saving control part 30A, the control part 30B, the maximum value setting part 30C, and the current command output part 30D are functions implemented by the controller 30.

The energy saving control part 30A is configured to derive a command value Qn for the discharge quantity based on a control pressure Pn. According to this embodiment, the energy saving control part 30A obtains the control pressure Pn output by the control pressure sensor 19, and refers to a reference table to drive the command value Qn corresponding to the obtained control pressure Pn. The reference table is a reference table that retains the correspondence between the control pressure Pn and the command value Qn such that the correspondence can be referred to, and is prestored in a nonvolatile storage. The correspondence between the control pressure Pn and the command value Qn retained in the reference table may be set in such a manner that the output power (for example, horsepower) of the engine 11 is not exceeded. Accordingly, in this case, the command value Qn corresponding to the obtained control pressure Pn is calculated to the extent that the output power of the engine 11 is not exceeded.

The control part 30B is configured to control a change in the command value Qn to moderate a change in the discharge quantity of the main pump 14. According to this embodiment, the control part 30B is configured to control the command value Qn. Specifically, the control part 30B is configured to control an increase or a decrease in the command value Qn. More specifically, the control part 30B receives the command value Qn as an input value and outputs a corrected command value Qna for the discharge quantity at predetermined operation intervals. When the increase (difference) of the input command value Qn of this time from the corrected command value Qna of the last time exceeds a maximum allowable value, the control part 30B outputs a value obtained by adding the maximum allowable value to the corrected command value Qn of the last time as the corrected command value Qna of this time. When the increase (difference) of the input command value Qn of this time from the corrected command value Qna of the last time is less than or equal to the maximum allowable value, the control part 30B outputs the command value Qn as the corrected command value Qna. The same applies to a decrease.

The maximum value setting part 30C is configured to output a maximum command value Qmax. The maximum command value Qmax is a command value corresponding to the maximum discharge quantity of the main pump 14. According to this embodiment, the maximum value setting part 30C is configured to output the maximum command value Qmax prestored in a nonvolatile storage or the like to the current command output part 30D.

The current command output part 30D is configured to output a current command to the regulator 13. According to this embodiment, the current command output part 30D outputs, to the regulator 13, a current command I derived based on the corrected command value Qna output by the control part 30B and the maximum command value Qmax output by the maximum value setting part 30C. The current command output part 30D may also output the current command I derived based on the corrected command value Qna to the regulator 13.

Figure 4:
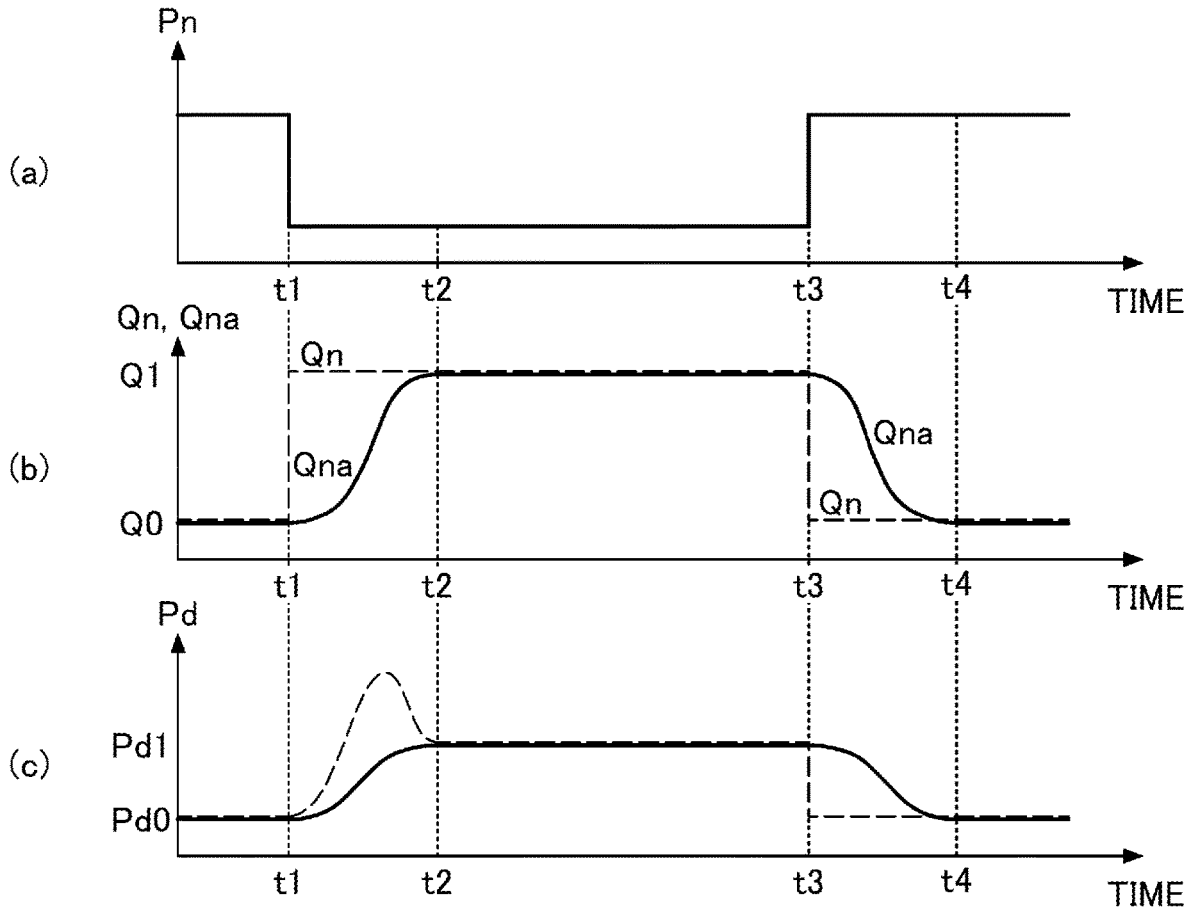
FIG. 4 is a chart illustrating an example of the temporal transition of the discharge pressure and the discharge quantity (command value) of a main pump.

Next, an effect due to the discharge quantity control function implemented by the controller 30 of FIG. 3 is described with reference to FIG. 4. In FIG. 4, (a) illustrates a temporal transition of the control pressure Pn when a boom raising operation is performed with a predetermined amount of operation. In FIG. 4, (b) illustrates a temporal transition of a value related to the actual discharge quantity Q of the main pump 14 when the boom raising operation is performed. The temporal transition of a value related to the actual discharge quantity Q includes the respective temporal transitions of the command value Qn (dashed line) and the corrected command value Qna (solid line). In FIG. 4, (c) illustrates a temporal transition of the discharge pressure Pd of the main pump 14 when the boom raising operation is performed. Specifically, in (c) of FIG. 4, the transition of the discharge pressure Pd when the corrected command value Qna is used is indicated by a solid line. Furthermore, in (c) of FIG. 4, the transition of the discharge pressure Pd in the hypothetical case where the command value Qn is used directly as the corrected command value Qna, that is, in the case where the control by the control part 30B is not applied, is indicated by a dashed line. The lines in (a) through (c) of FIG. 4 are smoothed for clarification.

In the case where the control by the control part 30B is not applied, when the boom raising operation is started at time t1, the command value Qn rapidly increases to a value Q1 commensurate with the amount of operation of the right operating lever 26R as indicated by the dashed line of (b) of FIG. 4. The controller 30 outputs the current command I derived based on the command value Qn (=the value Q1=the corrected command value Qna) to the regulator 13. Accordingly, the actual discharge quantity Q (not graphically illustrated) follows the rapid increase in the command value Qn to rapidly increase.

When the actual discharge quantity Q increases, the discharge pressure Pd rapidly increases as indicated by the dashed line of (c) of FIG. 4. This is because the flow rate of hydraulic oil to flow into the bottom-side chamber of the boom cylinder 7 is restricted by the inertia of the boom 4.

When the actual discharge quantity Q of the main pump 14 thus rapidly increases, the operator may feel uncomfortable with the operation of the shovel 100, for a shock is caused as the boom 4 moves.

Therefore, the controller 30 applies the control by the control part 30B to control the discharge quantity Q of the main pump 14 in a feed forward manner so as to be able to prevent a rapid increase in the discharge pressure Pd. In this case, the controller 30 can also smooth a change in the discharge pressure Pd.

In the case where the control by the control part 30B is applied, when the boom raising operation is started at time t1, the controller 30 derives the corrected command value Qna by controlling an increase in the command value Qn. Then, the controller 30 outputs the current command I derived based on the corrected command value Qna to the regulator 13. An increase per control cycle is controlled with respect to the corrected command value Qna. Therefore, the corrected command value Qna rises more slowly than the command value Qn (see the dashed line of (b) of FIG. 4) as indicated by the solid line of (b) of FIG. 4.

Therefore, the actual discharge quantity Q (not graphically illustrated) follows an increase in the corrected command value Qna to relatively gently increase until reaching time t2. Time t2 is a point of time at which the corrected command value Qna reaches the value Q1. After reaching the value Q1, the corrected command value Qna remains the value Q1 unless the amount of operation of the right operating lever 26R changes, namely, unless the control pressure Pn changes.

The discharge pressure Pd reaches a value Pd1 corresponding to the amount of operation of the right operating lever 26R without forming a peak unlike in the case where the control by the control part 30B is not applied (see the dashed line of (c) of FIG. 4), as indicated by the solid line of (c) of FIG. 4.

Thus, in the case where the control by the control part 30B is applied, the controller 30 can more smoothly control the discharge quantity Q of the main pump 14. Therefore, the controller 30 can prevent awkward movements of the attachment due to a temporary rapid increase in the discharge quantity Q.

The same applies to the case of stopping the boom raising operation. Specifically, in the case where the control by the control part 30B is not applied, when the boom raising operation is stopped, that is, when the right operating lever 26R is returned to a neutral position, at time t3, the command value Qn rapidly decreases to a value Q0 as indicated by the dashed line of (b) of FIG. 4. The value Q0 is, for example, a value corresponding to the standby flow rate. The controller 30 outputs the current command I derived based on the command value Qn (=the value Q0=the corrected command value Qna) to the regulator 13. Accordingly, the actual discharge quantity Q (not graphically illustrated) follows the rapid decrease in the command value Qn to rapidly decrease. When the actual discharge quantity Q rapidly decreases, the discharge pressure Pd rapidly decreases as indicated by the dashed line of (c) of FIG. 4.

When the actual discharge quantity Q of the main pump 14 thus rapidly decreases, the operator may feel uncomfortable with the operation of the shovel 100, for a shock is caused as the boom 4 stops.

Therefore, the controller 30 applies the control by the control part 30B to control the discharge quantity Q of the main pump 14 in a feed forward manner so as to be able to prevent a rapid decrease in the discharge pressure Pd. In this case, the controller 30 can also smooth a change in the discharge pressure Pd.

In the case where the control by the control part 30B is applied, when the boom raising operation is stopped at time t3, the controller 30 derives the corrected command value Qna by controlling a decrease in the command value Qn. Then, the controller 30 outputs the current command I derived based on the corrected command value Qna to the regulator 13. A decrease per control cycle is controlled with respect to the corrected command value Qna. Therefore, the corrected command value Qna falls more slowly than the command value Qn (see the dashed line of (b) of FIG. 4) as indicated by the solid line of (b) of FIG. 4.

Therefore, the actual discharge quantity Q (not graphically illustrated) follows a decrease in the corrected command value Qna to relatively gently decrease until reaching time t4. Time t4 is a point of time at which the corrected command value Qna reaches the value Q0. After reaching the value Q0, the corrected command value Qna remains the value Q0 unless the amount of operation of the right operating lever 26R changes, namely, unless the control pressure Pn changes.

The discharge pressure Pd reaches a value Pd0 of the standby state of the shovel 100 without rapidly decreasing unlike in the case where the control by the control part 30B is not applied (see the dashed line of (c) of FIG. 4), as indicated by the solid line of (c) of FIG. 4.

Thus, in the case where the control by the control part 30B is applied, the controller 30 can more smoothly control the discharge quantity Q of the main pump 14 when stopping the boom raising operation as well. Therefore, the controller 30 can prevent awkward movements of the attachment due to a temporary rapid decrease in the discharge quantity Q.

Figure 5:
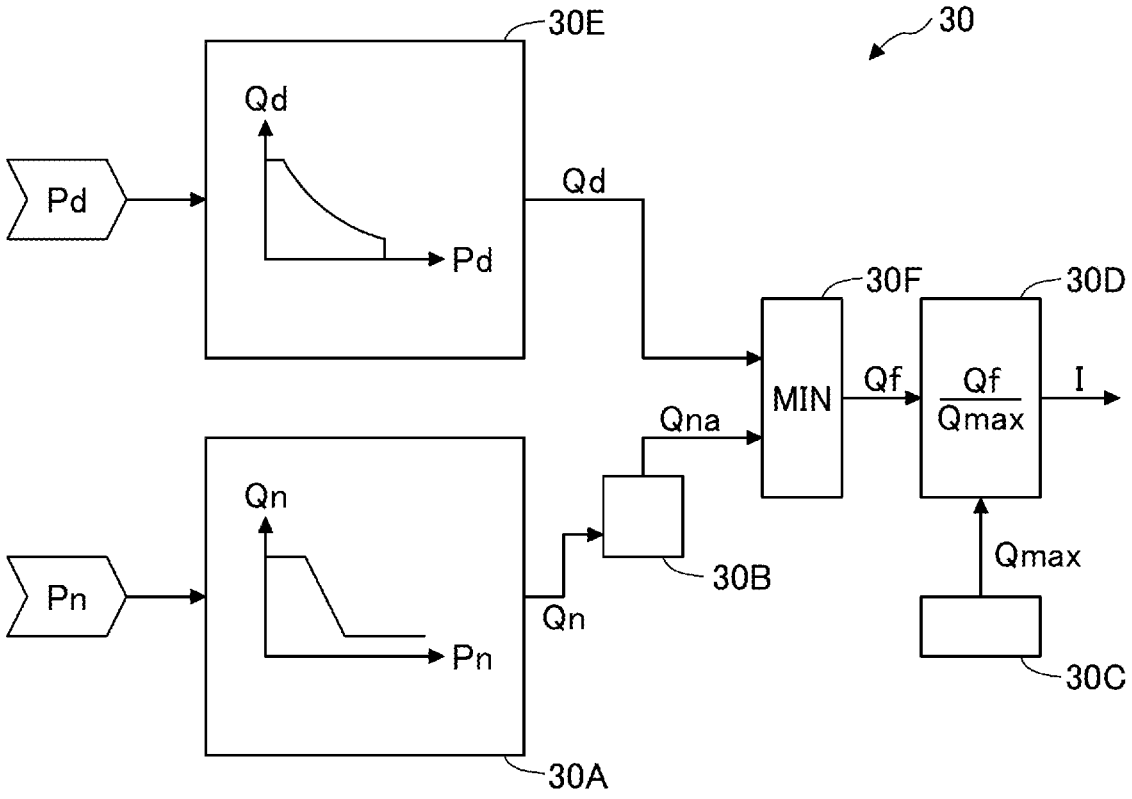
FIG. 5 is a diagram illustrating another example configuration of the discharge quantity control function.

Next, another example of the discharge quantity control function is described with reference to FIG. 5. FIG. 5 illustrates an example configuration of the controller 30 that implements another example of the discharge quantity control function. The controller 30 according to the example of FIG. 5 is different in including a power control part 30E and a minimum value selecting part 30F from, but otherwise equal to, the controller 30 of FIG. 3. Therefore, a description of a common portion is omitted, and differences are described in detail. The power control part 30E and the minimum value selecting part 30F are expressions used for convenience in describing functions of the controller 30, and do not have to be physically independent. The functions implemented by the power control part 30E and the minimum value selecting part 30F are functions implemented by the controller 30.

The power control part 30E is configured to derive a command value Qd for the discharge quantity Q based on the discharge pressure Pd of the main pump 14. According to this embodiment, the power control part 30E obtains the discharge pressure Pd output by the discharge pressure sensor 28. The power control part 30E refers to a reference table to derive the command value Qd corresponding to the obtained discharge pressure Pd. The reference table is a reference table regarding a P-Q diagram that retains the correspondence between the maximum allowable absorbable power (for example, maximum allowable absorbable horsepower) of the main pump 14, the discharge pressure Pd, and the command value Qd such that the correspondence can be referred to, and is prestored in a nonvolatile storage. For example, the power control part 30E can uniquely determine the command value Qd by referring to the reference table, using the preset maximum allowable absorbable horsepower of the main pump 14 and the discharge pressure Pd output by the discharge pressure sensor 28 as a search key.

The minimum value selecting part 30F is configured to select and output a minimum value from input values. According to this embodiment, the minimum value selecting part 30F is configured to output the smaller of the command value Qd and the corrected command value Qna as a final command value Qf.

The current command output part 30D outputs, to the regulator 13, the current command I derived based on the final command value Qf output by the minimum value selecting part 30F and the maximum command value Qmax output by the maximum value setting part 30C. The current command output part 30D may also output the current command I derived based on the final command value Qf to the regulator 13.

Figure 6:
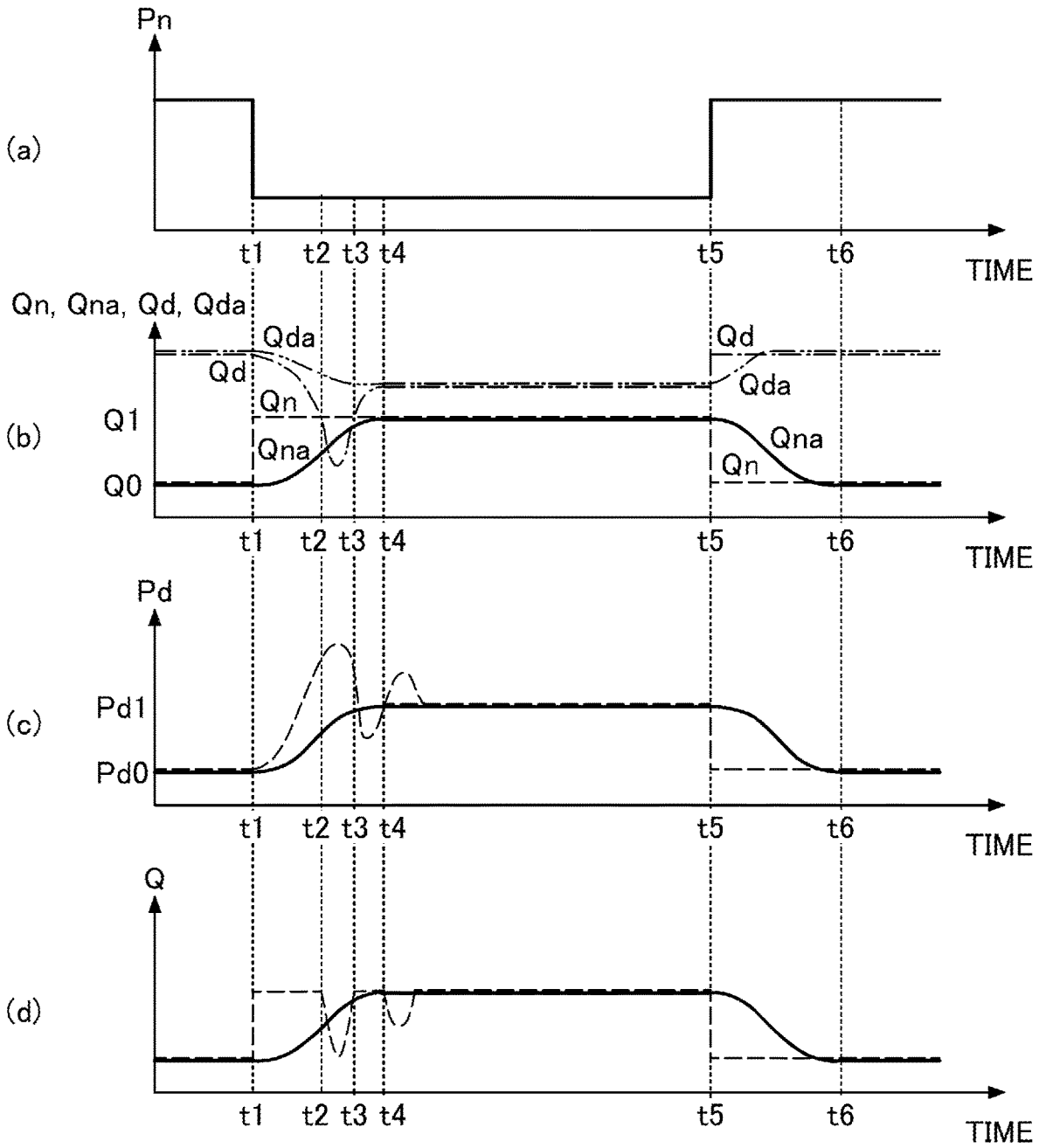
FIG. 6 is a chart illustrating another example of the temporal transition of the discharge pressure and the discharge quantity (command value) of a main pump.

Next, an effect due to the discharge quantity control function implemented by the controller 30 of FIG. 5 is described with reference to FIG. 6. In FIG. 6, (a) illustrates a temporal transition of the control pressure Pn when a boom raising operation is performed with a predetermined amount of operation. In FIG. 6, (b) illustrates a temporal transition of a value related to the actual discharge quantity Q of the main pump 14 when the boom raising operation is performed. The temporal transition of a value related to the actual discharge quantity Q includes the respective temporal transitions of the command value Qn (dashed line), the command value Qd (one-dot chain line), the corrected command value Qna (solid line), and a corrected command value Qda (two-dot chain line). The corrected command value Qda shows the command value Qd that changes according to the discharge pressure Pd when the corrected command value Qna is used. In FIG. 6, (c) illustrates a temporal transition of the discharge pressure Pd of the main pump 14 when the boom raising operation is performed. Specifically, in (c) of FIG. 6, the transition of the discharge pressure Pd when the corrected command value Qna is used as the final command value Qf is indicated by a solid line. Furthermore, in (c) of FIG. 6, the transition of the discharge pressure Pd in the hypothetical case where the command value Qn is used as the final command value Qf, that is, in the case where the control by the control part 30B is not applied, is indicated by a dashed line. In FIG. 6, (d) illustrates a temporal transition of the actual discharge quantity Q when the boom raising operation is performed. The lines in (a) through (d) of FIG. 6 are smoothed for clarification.

When the boom raising operation is started at time t1, the control pressure Pn rapidly decreases as illustrated in (a) of FIG. 6, and the command value Qn rapidly decreases as indicated by the dashed line of (b) of FIG. 6. If the control by the control part 30B is not applied, the controller 30 selects the command value Qn smaller than the command value Qd as the final command value Qf from time t1 to time t2, and selects the command value Qd smaller than the command value Qn as the final command value Qf from time t2 to time t3. The controller 30 outputs the current command I derived based on the final command value Qf to the regulator 13. Accordingly, the actual discharge quantity Q rapidly increases at time t1 and thereafter rapidly decreases at time t2 as indicated by the dashed line of (d) of FIG. 6. This rapid decrease is caused by the power control. That is, the actual discharge quantity Q is controlled to prevent the absorbed power of the main pump 14 from exceeding the output power of the engine 11, and rapidly decreases.

According to this embodiment, the controller 30 can prevent the occurrence of such a rapid increase and a rapid decrease in the actual discharge quantity Q. Specifically, the controller 30 derives the corrected command value Qn by controlling an increase in the command value Qn with the control part 30B. Therefore, the corrected command value Qna relatively gently increases as indicated by the solid line of (b) of FIG. 6. Then, the controller 30 selects the corrected command value Qna smaller than the corrected command value Qda indicated by the two-dot chain line of (b) of FIG. 6 as the final command value Qf, and outputs the current command I derived based on the final command value Qf to the regulator 13. Accordingly, the actual discharge quantity Q follows an increase in the final command value Qf (=the corrected command value Qna) to gently increase until reaching time t4 as indicated by the solid line of (d) of FIG. 6. Furthermore, according to the example of FIG. 6, the actual discharge quantity Q is not affected by the power control.

Thus, in the case where the control by the control part 30B is applied, the controller 30 can more smoothly control the discharge quantity Q of the main pump 14. Therefore, the controller 30 can prevent awkward movements of the attachment due to a temporary abrupt change in the discharge quantity Q.

The same applies to the case of stopping the boom raising operation. Specifically, in the case where the control by the control part 30B is not applied, when the boom raising operation is stopped, that is, when the right operating lever 26R is returned to a neutral position, at time t5, the command value Qn rapidly decreases to the value Q0 as indicated by the dashed line of (b) of FIG. 6. The controller 30 selects the command value Qn (=the value Q0=the corrected command value Qna) smaller than the command value Qd as the final command value Qf, and outputs the current command I derived based on the final command value Qf to the regulator 13. Accordingly, the actual discharge quantity Q follows the rapid decrease in the final command value Qf (the command value Qn) to rapidly decrease as indicated by the dashed line of (d) of FIG. 6. When the actual discharge quantity Q rapidly decreases, the discharge pressure Pd rapidly decreases as indicated by the dashed line of (c) of FIG. 6.

When the actual discharge quantity Q of the main pump 14 thus rapidly decreases, the operator may feel uncomfortable with the operation of the shovel 100, for a shock is caused as the boom 4 stops.

Therefore, the controller 30 applies the control by the control part 30B to control the discharge quantity Q of the main pump 14 in a feed forward manner so as to be able to prevent a rapid decrease in the discharge pressure Pd. In this case, the controller 30 can also smooth a change in the discharge pressure Pd.

In the case where the control by the control part 30B is applied, when the boom raising operation is stopped at time t5, the controller 30 derives the corrected command value Qna by controlling a decrease in the command value Qn. Then, the controller 30 selects the corrected command value Qna smaller than the corrected command value Qda as the final command value Qf, and outputs the current command I derived based on the final command value Qf to the regulator 13. A decrease per control cycle is controlled with respect to the corrected command value Qna. Therefore, the corrected command value Qna falls more slowly than the command value Qn (see the dashed line of (b) of FIG. 6) as indicated by the solid line of (b) of FIG. 6.

Therefore, the actual discharge quantity Q follows a decrease in the final command value Qf (the corrected command value Qna) to relatively gently decrease until reaching time t6 as indicated by the solid line of (d) of FIG. 6. Time t6 is a point of time at which the final command value Qf (the corrected command value Qna) reaches the value Q0. After reaching the value Q0, the final command value Qf (the corrected command value Qna) remains the value Q0 unless the amount of operation of the right operating lever 26R and the discharge pressure Pd change, namely, unless the control pressure Pn and the discharge pressure Pd change.

The discharge pressure Pd reaches the value Pd0 of the standby state of the shovel 100 without rapidly decreasing unlike in the case where the control by the control part 30B is not applied (see the dashed line of (c) of FIG. 6), as indicated by the solid line of (c) of FIG. 6.

Thus, in the case where the control by the control part 30B is applied, the controller 30 can more smoothly control the discharge quantity Q of the main pump 14 when stopping the boom raising operation as well. Therefore, the controller 30 can prevent awkward movements of the attachment due to a temporary abrupt change in the discharge quantity Q.

While controlling a change in the command value Qn by reducing an increase or a decrease in the command value Qn according to the above-described embodiment, the control part 30B may also control a change in the command value Qn by reducing an increase rate or a decrease rate.

The control part 30B may also be configured to operate as a filter. For example, the control part 30B may be configured to operate as a first-order lag filter as a first-order lag element. In this case, the control part 30B may be configured as an electrical circuit such as a limiter.

The control part 30B may be configured to operate as a filter for the command value Qn derived by the energy saving control part 30A or may be configured to operate as a filter for the control pressure Pn detected by the control pressure sensor 19. For example, the control part 30B may be placed to succeed the energy saving control part 30A as illustrated in FIGS. 3 and 5 or may be placed to precede the energy saving control part 30A. In the case of being placed to precede the energy saving control part 30A, the control part 30B may be configured to output a corrected control pressure Pna (not graphically illustrated) obtained by controlling a change in the control pressure Pn to the energy saving control part 30A.

The control part 30B may cause the degree of control to differ between when the command value Qn rises and when the command value Qn falls. For example, the control part 30B may cause the filter time constant of a first-order lag filter used when the command value Qn rises to differ from the filter time constant of a first-order lag filter used when the command value Qn falls.

The control part 30B may be configured to control a change in the command value Qn such that the transition pattern of the command value Qn matches a prestored predetermined transition pattern.

The control part 30B may change the degree of control of the command value Qn according to the operating mode (set mode) of the shovel 100. For example, the control part 30B may change the degree of control of the command value Qn according to the current rotational speed mode set by the engine rotational speed adjustment dial 75. For example, the control part 30B may cause the degree of control to differ between when the SP mode is selected and when the A mode is selected.

The control part 30B may change the degree of control of the command value Qn according to the operation details of the shovel 100. Examples of operation details include a boom raising operation, a boom lowering operation, an arm closing operation, an arm opening operation, a bucket closing operation, a bucket opening operation, a swing operation, and a travel operation. For example, the control part 30B may cause the degree of control of the command value Qn to differ between when a travel operation is performed and when a swing operation is performed.

Furthermore, according to the above-described embodiment, the energy saving control part 30A is configured to derive the command value Qn for the discharge quantity based on the control pressure Pn detected by the control pressure sensor 19. The energy saving control part 30A, however, may be configured to estimate the control pressure Pn based on at least one of the discharge quantity of the main pump 14, the pressure of hydraulic oil in a hydraulic actuator, the state of each of the control valves 171 through 176, the amount of operation of the operating device 26, etc., and derive the command value Qn for the discharge quantity based on the estimated control pressure Pn. In this case, the state of each of the control valves 171 through 176 may be represented by, for example, the displacement of a spool valve detected by a spool stroke sensor.

According to the above-described configuration, the controller 30 can control the discharge quantity Q of the main pump 14 electrically and in a feed forward manner so that the discharge quantity Q of the main pump 14 smoothly changes even when the operating device 26 is rapidly operated. Therefore, the shovel 100 can control a shock that is caused at the start of moving a hydraulic actuator, for example. Furthermore, the shovel 100 can control a shock that is caused when there is an abrupt change in the amount of operation of the operating device 26. As a result, the above-described configuration can improve the operability of the shovel 100. Furthermore, the above-described configuration can reduce or eliminate the operator's discomfort.

As described above, the shovel 100 according to an embodiment of the present invention includes the lower traveling structure 1, the upper swing structure 3 swingably mounted on the lower traveling structure 1, the engine 11 mounted on the upper swing structure 3, the main pump 14 serving as a hydraulic pump driven by the engine 11, the control pressure sensor 19 serving as a negative control pressure sensor, and the controller 30 serving as a control device that determines a command value by energy saving control and controls the flow rate of hydraulic oil discharged by the main pump 14 according to the command value. The controller 30 is configured to be able to control the command value. According to this configuration, the shovel 100 can control a shock that is caused when moving a hydraulic actuator.

The controller 30 may be configured to limit an increase in the flow rate of hydraulic oil discharged by the main pump 14 responsive to a decrease in the pressure of hydraulic oil at a predetermined position in a hydraulic circuit that is caused when a hydraulic actuator operates. Specifically, for example, the controller 30 may be configured to limit an increase in the discharge quantity Q responsive to a decrease in the control pressure (negative control pressure) that is the pressure of hydraulic oil upstream of the throttle 18 in the hydraulic circuit illustrated in FIG. 2. The controller 30 may also be configured to limit a decrease in the flow rate of hydraulic oil discharged by the main pump 14 responsive to an increase in the pressure of hydraulic oil at a predetermined position in a hydraulic circuit that is caused when a hydraulic actuator operates. Specifically, for example, the controller 30 may be configured to limit a decrease in the discharge quantity Q responsive to an increase in the control pressure (negative control pressure) that is the pressure of hydraulic oil upstream of the throttle 18 in the hydraulic circuit illustrated in FIG. 2. According to these configurations, the controller 30 can moderate changes in the discharge quantity Q of the main pump 14.

The controller 30 may also be configured to control the size of a change in the command value Qn at the start of an operation with an operating lever. Specifically, for example, the controller 30 may be configured to reduce an increase in the command value Qn at the start of the operation of raising the boom 4 with the right operating lever 26R. According to this configuration, the controller 30 can control a shock caused at the start of operating the boom cylinder 7.

The controller 30 may also be configured to control the size of a change in the command value Qn when there is a change in the amount of operation of an operating lever. Specifically, for example, the controller 30 may be configured to reduce an increase in the command value Qn when there is a change in the amount of operation of the right operating lever 26R in the boom raising direction. According to this configuration, the controller 30 can control a shock caused when the rate of extension of the boom cylinder 7 is increased.

An embodiment of the present invention is described in detail above. The present invention, however, is not limited to the above-described embodiment. Various variations, substitutions, etc., may be applied to the above-described embodiment without departing from the scope of the present invention. Furthermore, the separately described features may be combined to the extent that no technical contradiction is caused.

For example, according to the above-described embodiment, hydraulic operating levers including a hydraulic pilot circuit are disclosed. Specifically, in a hydraulic pilot circuit associated with the left operating lever 26L, hydraulic oil supplied from the pilot pump 15 to the left operating lever 26L is conveyed to a pilot port of the control valve 176 at a flow rate commensurate with the degree of opening of a remote control valve that is opened or closed by the tilt of the left operating lever 26L in the arm opening direction. In a hydraulic pilot circuit associated with the right operating lever 26R, hydraulic oil supplied from the pilot pump 15 to the right operating lever 26R is conveyed to a pilot port of the control valve 175 at a flow rate commensurate with the degree of opening of a remote control valve that is opened or closed by the tilt of the right operating lever 26R in the boom raising direction.

Instead of such hydraulic operating levers including a hydraulic pilot circuit, however, electric operating levers with an electric pilot circuit may be adopted. In this case, the amount of lever operation of an electric operating lever is input to the controller 30 as an electrical signal, for example. Furthermore, a solenoid valve is placed between the pilot pump 15 and a pilot port of each control valve. The solenoid valve is configured to operate in response to an electrical signal from the controller 30. According to this configuration, when a manual operation using the electric operating lever is performed, the controller 30 can move each control valve by increasing or decreasing a pilot pressure by controlling the solenoid valve in response to an electrical signal commensurate with the amount of lever operation. Each control valve may be constituted of a solenoid spool valve. In this case, the solenoid spool valve is configured to operate in response to an electrical signal from the controller 30. That is, the solenoid spool valve is electrically controlled by the controller 30 without the intervention of a pilot pressure.

Furthermore, the operating device 26, which is installed in the cabin 10 of the shovel 100 according to the above-described embodiment, may be installed outside the cabin 10. For example, the operating device 26 may be installed in a remote control room at a location distant from the shovel 100.

Furthermore, the controller 30, which is installed in the shovel 100 according to the above-described embodiment, may be installed outside the shovel 100. For example, the controller 30 may be installed in a remote control room at a location distant from the shovel 100.

What is claimed is:

1. A shovel comprising:

a lower traveling structure;

an upper swing structure swingably mounted on the lower traveling structure;

an attachment attached to the upper swing structure;

an actuator configured to drive the attachment;

an engine mounted on the upper swing structure;

a hydraulic pump configured to be driven by the engine to discharge hydraulic oil;

a regulator configured to control a discharge quantity of the hydraulic pump;

a hydraulic circuit configured to circulate the hydraulic oil discharged by the hydraulic pump to the actuator;

a hydraulic oil tank;

a control valve unit provided in the hydraulic circuit and configured to control a flow rate of the hydraulic oil flowing from the hydraulic pump to the actuator and flowing from the actuator to the hydraulic oil tank;

a throttle placed downstream of the control valve unit and upstream of the hydraulic oil tank in a conduit connecting the control valve unit and the hydraulic oil tank;

a negative control pressure sensor configured to detect a pressure of the hydraulic oil generated by the throttle at a predetermined position upstream of the throttle in the conduit and to output the detected pressure of the hydraulic oil as an electric signal; and processing circuitry configured to decrease a flow rate of the hydraulic oil discharged by the hydraulic pump to a standby flow rate based on the electric signal output by the negative control pressure sensor, wherein the processing circuitry is configured to limit an increase in the flow rate of the hydraulic oil discharged by the hydraulic pump by controlling an increase in a command value for the discharge quantity of the hydraulic pump, the command value corresponding to the detected pressure of the hydraulic oil, in a case of increasing the flow rate from the standby flow rate in response to a decrease in the detected pressure, the decrease being caused by supplying the hydraulic oil to the actuator in response to the actuator being operated, the processing circuitry is configured to generate a corrected command value for deriving an electrical command signal to be output to the regulator, based on the command value at predetermined operation intervals, and the processing circuitry is configured to determine whether an increase of a current command value from a last corrected command value exceeds a predetermined value, generate a current corrected command value by adding the predetermined value to the last corrected command value, in response to determining that the increase of the current command value from the last corrected command value exceeds the predetermined value, derive the electrical command signal based on the current corrected command value, and output the derived electrical command signal to the regulator so that the regulator controls the discharge quantity of the hydraulic pump based on the electrical command signal.

2. The shovel as claimed in claim 1, wherein the processing circuitry is configured to change a degree of controlling the increase according to a rotational speed mode of the engine.

3. The shovel as claimed in claim 1, wherein the processing circuitry is configured to change a degree of controlling the increase according to operation details of the actuator.

4. The shovel as claimed in claim 1, wherein the processing circuitry is further configured to output a first command to decrease the flow rate of the hydraulic oil to the standby flow rate based on the detected pressure;

output a second command to increase the flow rate from the standby flow rate in response to the decrease in the detected pressure;

control a degree of decrease of the first command per control cycle; and control a degree of increase of the second command per control cycle.

5. The shovel as claimed in claim 1, wherein the processing circuitry is configured to set the current command value as the current corrected command value, in response to determining that the increase of the current command value from the last corrected command value is less than or equal to the maximum allowable value.

6. A method of controlling a shovel, the shovel including a lower traveling structure, an upper swing structure swingably mounted on the lower traveling structure, an attachment attached to the upper swing structure, an actuator configured to drive the attachment, an engine mounted on the upper swing structure, a hydraulic pump configured to be driven by the engine to discharge hydraulic oil, a regulator configured to control a discharge quantity of the hydraulic pump, a hydraulic circuit configured to circulate the hydraulic oil discharged by the hydraulic pump to the actuator, a hydraulic oil tank, a control valve unit provided in the hydraulic circuit and configured to control a flow rate of the hydraulic oil flowing from the hydraulic pump to the actuator and flowing from the actuator to the hydraulic oil tank, a throttle placed downstream of the control valve unit and upstream of the hydraulic oil tank in a conduit connecting the control valve unit and the hydraulic oil tank, a negative control pressure sensor configured to detect a pressure of the hydraulic oil generated by the throttle at a predetermined position upstream of the throttle in the conduit and to output the detected pressure of the hydraulic oil as an electric signal, and processing circuitry, the method comprising:

decreasing, by the processing circuitry, a flow rate of the hydraulic oil discharged by the hydraulic pump to a standby flow rate based on the electric signal output by the negative control pressure sensor;

limiting, by the processing circuitry, an increase in the flow rate of the hydraulic oil discharged by the hydraulic pump by controlling an increase in a predetermined command value for the discharge quantity of the hydraulic pump, the predetermined command value corresponding to the detected pressure of the hydraulic oil, in a case of increasing the flow rate from the standby flow rate in response to a decrease in the detected pressure, the decrease being caused by supplying the hydraulic oil to the actuator in response to the actuator being operated;

generating, by the processing circuitry, a corrected command value for deriving an electrical command signal to be output to the regulator, based on the command value at predetermined operation intervals;

determining whether an increase of a current command value from a last corrected command value exceeds a predetermined value;

generating, by the processing circuitry, a current corrected command value by adding the predetermined value to the last corrected command value, in response to determining that the increase of the current command value from the last corrected command value exceeds the predetermined value;

deriving, by the processing circuitry, the electrical command signal based on the current corrected command value; and outputting, by the processing circuitry, the derived electrical command signal to the regulator so that the regulator controls the discharge quantity of the hydraulic pump based on the electrical command signal.

7. The method as claimed in claim 6, further comprising:

changing, by the processing circuitry, a degree of controlling the increase according to a rotational speed mode of the engine.

8. The method as claimed in claim 6, further comprising:

changing, by the processing circuitry, a degree of controlling the increase according to operation details of the actuator.

9. The method as claimed in claim 6, further comprising:

outputting, by the processing circuitry, a first command to decrease the flow rate of the hydraulic oil to the standby flow rate based on the detected pressure;

outputting, by the processing circuitry, a second command to increase the flow rate from the standby flow rate in response to the decrease in the detected pressure;

controlling, by the processing circuitry, a degree of decrease of the first command per control cycle; and controlling, by the processing circuitry, a degree of increase of the second command per control cycle.

10. The method as claimed in claim 6, further comprising:

setting, by the processing circuitry, the current command value as the current corrected command value, in response to determining that the increase of the current command value from the last corrected command value is less than or equal to the maximum allowable value.

* * * * *